United States Patent [19]

Iaia et al.

[11] Patent Number: 5,027,838

[45] Date of Patent: Jul. 2, 1991

[54] COSMETIC APPLICATOR BRUSH

[75] Inventors: Mark J. Iaia, Pearl River, N.Y.; Randy Wheaton, Danbury, Conn.

[73] Assignee: Chesebrough-Pond's USA Co., division of Conopco, Inc., Greenwich, Conn.

[21] Appl. No.: 523,452

[22] Filed: May 14, 1990

[51] Int. Cl.[5] ..... A46B 11/00

[52] U.S. Cl. ..... 132/218; 132/320

[58] Field of Search ..... 132/218, 320, 123, 151; 15/206; 401/238, 122

[56] References Cited

U.S. PATENT DOCUMENTS

| | | | |
|---|---|---|---|
| 2,245,906 | 6/1941 | Deakers et al. | 132/320 |
| 3,260,269 | 7/1966 | Zurndorfer | 132/123 |
| 3,468,612 | 9/1969 | Aston | 132/320 |
| 3,739,789 | 6/1973 | Cataneo | 132/320 |
| 3,741,666 | 6/1973 | Vasas et al. | 401/127 |
| 3,991,777 | 11/1976 | Powers et al. | 132/320 |
| 3,998,235 | 12/1976 | Kingsford | 132/218 |
| 4,167,192 | 9/1979 | Arnold | 15/206 |
| 4,327,753 | 5/1982 | Bertschi | 132/123 |
| 4,437,477 | 3/1984 | Gueret | 132/320 |
| 4,446,880 | 5/1984 | Gueret et al. | 132/88.5 |
| 4,467,821 | 8/1984 | Stewart | 132/123 |
| 4,498,490 | 2/1985 | Seidler | 132/218 |
| 4,586,520 | 5/1986 | Brittain | 132/88.7 |
| 4,598,723 | 7/1986 | Cole | 132/88.7 |
| 4,662,385 | 5/1987 | Schefer | 132/218 |
| 4,705,053 | 11/1987 | Goncalves | 132/123 |
| 4,810,122 | 3/1989 | Cole | 132/218 |
| 4,927,281 | 5/1990 | Gurrea | 132/218 |

*Primary Examiner*—Paul J. Hirsch

*Attorney, Agent, or Firm*—Milton L. Honig

[57] ABSTRACT

A cosmetic applicator is provided having a brush with radially adjustable length bristles. The applicator includes a brush head, a shaft and a sleeve. The brush head has an elongated brush stem with a plurality of bristle tufts circumferentially attached radiating outwardly therefrom. A plurality of slots are provided in an end of the sleeve through which the bristle tufts are forced to protrude. The brush head and shaft to which the latter is attached are held within the sleeve. Upon rotation, the bristle tufts can wind or unwind, depending upon direction of rotation, around the brush stem. In this manner, the effective outward radial length of each bristle tuft can be rendered adjustable.

8 Claims, 2 Drawing Sheets

FIG. 3
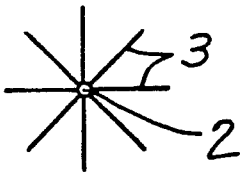
FIG. 5
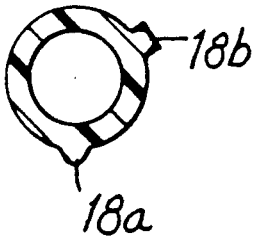
FIG. 6
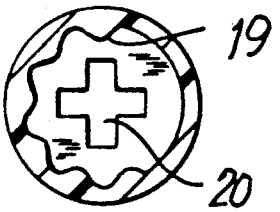
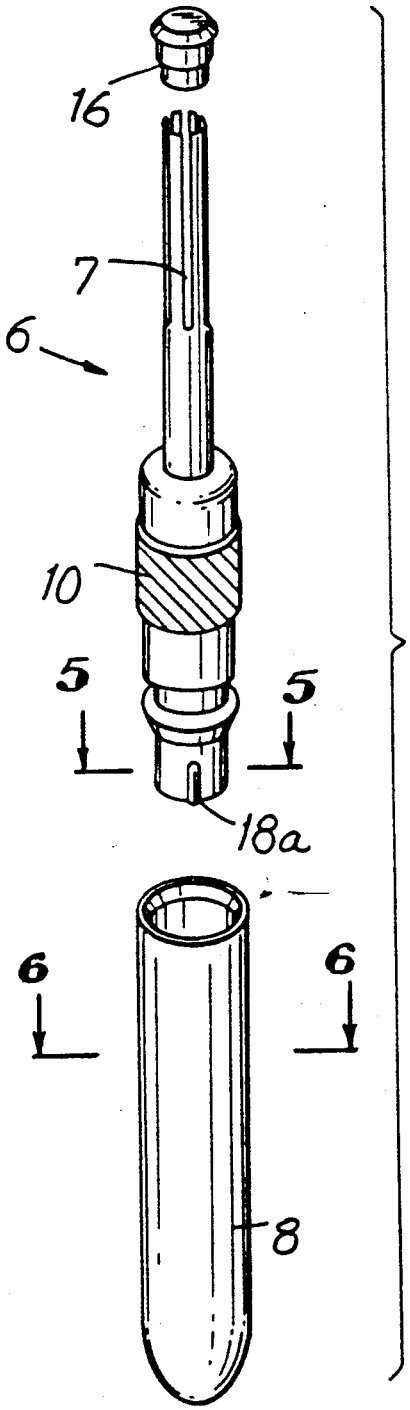
FIG. 4

COSMETIC APPLICATOR BRUSH

BACKGROUND OF THE INVENTION

1. Field of the Invention

The invention concerns a mascara applicator whose brush has adjustable length bristles.

2. The Related Art

Numerous types of mascara applicators and systems have been described in the art. Certain ones have adjustable features allowing for versatility in applying greater or lesser amounts of mascara. Adjustability also permits flexibility for interacting with various eyelash thicknesses. Moreover, a single applicator can service brush preferences of any individual.

U.S. Pat. No. 4,446,880 (Gueret et al) reports an eyelash brush which includes a bellows or longitudinally slit sleeve defining bristles and adapted to be varied in diameter by variation in length. A disadvantage with this system is the absence of fine bristles, these being replaced by supple stumps. Accurate detailed mascara application cannot be accomplished with these stumps.

U.S. Pat. No. 4,598,723 (Cole) describes a device having a twisted wire brush carried at the end of a support shaft and surrounded by a sleeve wherein the brush bristles are held in a compressed state. An opening at the end of the sleeve permits the brush to extend outside at various controlled lengths. Although there is longitudinal control, there is no radial control of the bristle length.

U.S. Pat. No. 3,741,666 (Vasas et al) discloses a cosmetic applicator in which the length of the brush is selectively adjustable. The device utilizes a paint brush tip whose bristles are longitudinally directed rather than extending in a radially outward direction. There is of course no radial adjustability with this mechanism and brush.

U.S. Pat. No. 4,586,520 (Brittain) illustrates a mascara applicator whose brush contains alternating rows of long and short bristles. Unfortunately, the applicator bristles cannot be adjusted in any direction.

Accordingly, it is the object of the present invention to provide an improved cosmetic applicator capable of being adjusted to retain variable quantities of cosmetic product.

Another object of the present invention is to provide a cosmetic applicator, for applying mascara, whose radial length can be adjusted to reflect preferences of individual users.

A still further object of the present invention is to provide a cosmetic applicator capable of a simple, economical adjustment whereby the radial length of bristles can be varied to conform to various length eyelashes.

These and other objects of the present invention will become more apparent by consideration of the following detailed description and drawings.

SUMMARY OF THE INVENTION

A cosmetic applicator is provided comprising:

- a brush head having an elongated brush stem and a plurality of bristle tufts attached circumferentially around the stem radiating outwardly therefrom;
- a shaft having first and second ends, the brush head being attached to the first end of the shaft;
- a sleeve having a first and second end, a plurality of elongated slots being formed in the sleeve at the first sleeve end, the brush head being held within the sleeve, and the bristle tufts extending radially outward through the slots.

By rotating the sleeve, the bristle tufts are caused to twist around the brush stem. Thereupon, the bristle tufts which protrude through the slots of the sleeve will become longer or shorter depending on direction of rotation.

BRIEF DESCRIPTION OF THE DRAWING

Preferred embodiments of the present invention will now be described by way of example with reference to the accompanying drawing in which:

FIG. 3 is a cross section of the brush head taken along line 3—3 of FIG. 2;

FIG. 4 is an exploded part-separated view of the sleeve assembly with base;

FIG. 5 is a cross section of the sleeve end which engages an end of the shaft taken along line 5—5 of FIG. 4; and FIG. 6 is a cross section of the rotatable base taken along line 6—6 of FIG. 5.

DETAILED DESCRIPTION

Figure 1:
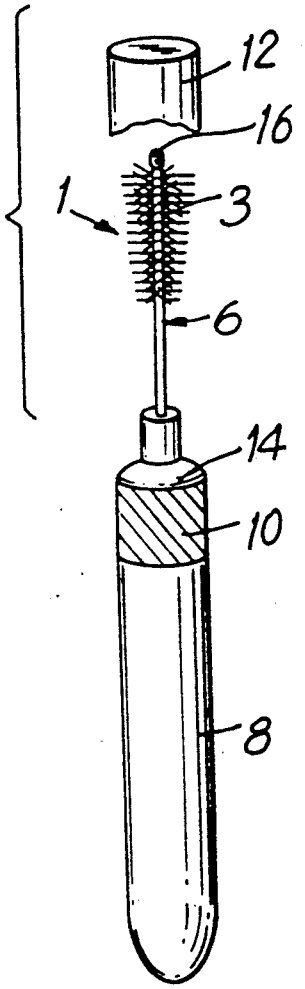
FIG. 1 is a perspective view of the applicator.

FIG. 1 illustrates the assembled adjustable length applicator. This device may be constructed of six major parts including brush head 1, sleeve 6, cap 8, threaded bottle 12, wiper plug 14 and recepticle plug 16.

Figure 2:
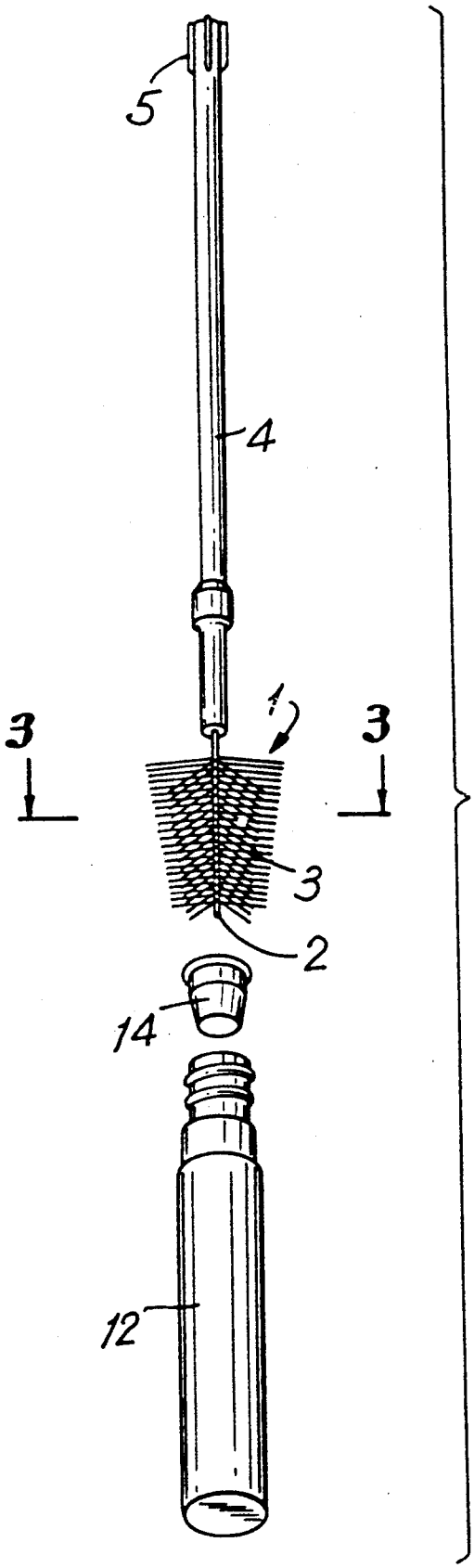
FIG. 2 is an exploded part-separated view of the brush assembly.

FIG. 2 illustrates parts of the brush assembly. A brush head 1 is formed at one end of a shaft 4. The brush head 1 includes an elongated brush stem 2, preferably formed from a twisted wire, and a plurality of bristle tufts 3 attached circumferentially around stem 2 radiating outwardly therefrom. Brush head 1 is uniformly cylindrical and along an entire length thereof has bristle tufts 3 oriented transverse to the brush stem 2. As seen from FIG. 3, the bristle tufts 3 are arranged equidistant circumferentially surrounding stem 2. Each tuft row is longitudinally distanced from an adjacent row by an arc ranging from 10° to 60°, preferably between 15° to 45°.

FIG. 4 illustrates the sleeve assembly. This assembly includes a sleeve 6 having a first and second end. A plurality of elongated slots 7 are formed in sleeve 6 at the first end thereof. These slots 7 coincide in number and spacial relationship with that of the bristle tufts 3 so that the latter may protrude through the former upon assembly. Along a middle area of sleeve 6 there is fashioned a friction knob 10 for rotatably manipulating the sleeve 6. At the second end of the sleeve, distant from the slots, there is a rounded projection **18*a* and a squared projection 18*b***.

A cap 8 serves as a holder by which the applicator may be grasped. Formed within cap 8 is a ratchet track 19 for receiving the second end of sleeve 6. Projections **18*a* and 18*b* are positioned complementary to ratchet track 19. Upon rotation of friction knob 10, rounded projection 18*a* will stepwise move between individual teeth of the ratchet track 19. Movement will be stopped when the squared projection 18*b* interacts with a terminal tooth of track 19**.

Shaft 4 at an end distant from the brush head is fitted with a plurality of detents 5 projecting outwardly from the shaft. A hollow crosspiece 20 having a plurality of arms is formed within cap 8 at a closed end thereof.

Detents 5 to secure shaft 4 against rotation are inserted into the hollow crosspiece 20.

A cylindrical hollow wiper plug 14 is fitted into the mouth of a threaded bottle 12. Mascara, eye-shadow or other cosmetic may be placed into the threaded bottle 12. Plug 14 is preferably formed from an elastomeric material such as silicone rubber. An inner diameter of plug 14 will normally be smaller than but capable of stretching to fit over sleeve 6 and brush head 1. Upon insertion of head 1 through plug 14, the latter will wipe clean the head 1. Contrary to known wipe systems, cosmetic product will not be forced to the interior near the stem of head 1. Sleeve 6 advantageously prevents such movement.

A recepticle plug 16 is fashioned to fit into a mouth of sleeve 6 at the first end thereof. Plug 16 functions in concert with crosspiece 20 to prevent shaft 4 from rotating. Additionally, plug 16 prevents cosmetic product from entering sleeve 6.

Shaft 4 with brush head 1 is fitted within sleeve 6. Each of the bristle tufts 3 are positioned to emerge radially outward through slots 7.

With the applicator device as just described, the radial length of the bristles can be adjusted in a most simple manner. The shortening of bristle length is accomplished by gripping friction knob 10 and rotating this knob through a small arc. Movement of knob 10 causes bristle tufts 3 to wind or unwind around the brush stem 2 depending upon direction of rotation. In this manner, the bristles may either be lengthened or shortened.

Although the invention has been described with reference to specific embodiments, it shall be duly understood that it is in no way limited thereto and that various modifications of shape and materials may be brought thereto without departing either from the scope or spirit of the invention.

What is claimed is:

1. A cosmetic applicator comprising:

a brush head having an elongated brush stem and a plurality of bristle tufts attached circumferentially around said stem radiating outwardly therefrom;

a shaft having first and second ends, said brush head attached to said first end of said shaft;

a sleeve having a first and second end, a plurality of elongated slots being formed in said sleeve at said first sleeve end, said brush head being held within said sleeve, and said bristle tufts extending radially outward through said slots; and a means for rotatably engaging said shaft with said sleeve causing said bristle tufts to twist around said brush stem thereby adjusting the radial length of said bristle tufts as they protrude through said slots of said sleeve.

2. An applicator according to claim 1 further comprising a hollow cap into which said second end of said sleeve projects.

3. An applicator according to claim 2 wherein said means comprises a projection on said second end of said sleeve and a ratchet track formed within said cap, said projection engaging with said ratchet track.

4. An applicator according to claim 2 further comprising a plurality of detents projecting outwardly from said second end of said shaft.

5. An applicator according to claim 4 further comprising a hollow crosspiece within said cap at a closed end thereof, said detents fitting within said crosspiece.

6. An applicator according to claim 1 further comprising a bottle containing a cosmetic and an elastomeric wiper plug fitted within a mouth of said bottle.

7. An applicator according to claim 1 further comprising a recepticle plug positioned at said first end of said sleeve above said slots.

8. An applicator according to claim 1 wherein said bristle tufts are arranged in rows along a length of said brush stem, each of said rows being separated from one another by an arc of at least 10°.

* * * * *